US009308659B2

(12) United States Patent
Feil

(10) Patent No.: US 9,308,659 B2
(45) Date of Patent: Apr. 12, 2016

(54) FIBER CUTTING DEVICE

(75) Inventor: Matthias Feil, Ravensburg (DE)

(73) Assignee: Schmidt & Heinzmann GmbH & Co. KG, Bruchsal (DE)

( * ) Notice: Subject to any disclaimer, the term of this patent is extended or adjusted under 35 U.S.C. 154(b) by 317 days.

(21) Appl. No.: 13/822,019

(22) PCT Filed: Sep. 12, 2011

(86) PCT No.: PCT/EP2011/004575

§ 371 (c)(1),
(2), (4) Date: May 7, 2013

(87) PCT Pub. No.: WO2012/034675

PCT Pub. Date: Mar. 22, 2012

(65) Prior Publication Data

US 2013/0213204 A1 Aug. 22, 2013

(30) Foreign Application Priority Data

Sep. 16, 2010 (DE) ..... 10 2010 045 702

(51) Int. Cl.
*B26D 1/28* (2006.01)
*B26D 7/26* (2006.01)
*D01G 1/04* (2006.01)

(52) U.S. Cl.
CPC *B26D 1/28* (2013.01); *B26D 1/285* (2013.01); *B26D 7/2621* (2013.01); *D01G 1/04* (2013.01); *Y10T 83/9396* (2015.04)

(58) Field of Classification Search
CPC ..... B26D 1/28; B26D 1/285; B26D 7/2621; D01G 1/04; Y10T 83/9396
USPC ..... 83/37, 42
See application file for complete search history.

(56) References Cited

U.S. PATENT DOCUMENTS 2,184,452 A 10/1937 Grunert
2,173,789 A * 9/1939 Nikles ..... D01G 1/04 19/46
2,851,103 A * 9/1958 Anthony ..... D01G 1/04 83/345
3,119,294 A * 1/1964 Billingsley ..... D01G 1/04 83/174
3,472,107 A * 10/1969 Heijnis ..... 83/76.6
3,507,180 A * 4/1970 Greenberg ..... 83/592
3,735,661 A * 5/1973 Eichler et al. ..... 83/675

(Continued)

FOREIGN PATENT DOCUMENTS

BE 716012 A 10/1968
DE 2010940 A1 10/1970

(Continued)

OTHER PUBLICATIONS

Office Action dated May 6, 2014 issued in the corresponding CA patent application No. 2,812,183.

(Continued)

*Primary Examiner* — Sean Michalski
(74) *Attorney, Agent, or Firm* — POSZ Law Group, PLC

(57) ABSTRACT

The invention proceeds from a converter cutting device for a converter which is provided for converting at least one endless fiber into cut fibers, having at least one cutting unit which can be driven rotationally about a rotational axis and comprises at least one cutting means with at least one blade. It is proposed that the cutting means encloses a cutting angle which does not equal 0 degrees with a plane which is oriented perpendicularly with respect to the rotational axis.

17 Claims, 4 Drawing Sheets

(56) References Cited

U.S. PATENT DOCUMENTS

| | | | | |
|---|---|---|---|---|
| 3,831,482 | A * | 8/1974 | Eichler et al. | 83/675 |
| 3,881,383 | A * | 5/1975 | Alverth et al. | 83/308 |
| 4,048,884 | A * | 9/1977 | Winn, Jr. | 83/24 |
| 4,083,276 | A * | 4/1978 | Hutzezon | 83/37 |
| 4,249,441 | A * | 2/1981 | Sturtz | 83/347 |
| 4,251,198 | A * | 2/1981 | Altenburg | 425/67 |
| 4,391,169 | A * | 7/1983 | Laird et al. | 83/37 |
| 4,840,098 | A * | 6/1989 | Gammerler | 83/841 |
| 4,967,969 | A * | 11/1990 | Griffith, III | 241/93 |
| 5,916,343 | A * | 6/1999 | Huang et al. | 82/59 |
| 6,267,035 | B1 * | 7/2001 | Bascom et al. | 83/346 |
| 6,453,704 | B2 * | 9/2002 | Arterburn et al. | 65/475 |
| 6,599,178 | B1 * | 7/2003 | Gluche | B23P 15/28 451/540 |
| 8,721,317 | B2 * | 5/2014 | Scheurich | 425/315 |
| 8,940,207 | B2 * | 1/2015 | Mueller et al. | 264/143 |
| 2002/0069732 | A1 * | 6/2002 | Waggoner et al. | 83/13 |
| 2002/0104420 | A1 * | 8/2002 | Bascom | C03B 37/16 83/665 |
| 2002/0112579 | A1 * | 8/2002 | Jager | 83/37 |
| 2004/0003699 | A1 * | 1/2004 | Welch | 83/658 |
| 2004/0025658 | A1 * | 2/2004 | Fisher et al. | 83/663 |
| 2004/0173067 | A1 * | 9/2004 | Li et al. | 83/13 |
| 2006/0201306 | A1 * | 9/2006 | Zannini | 83/698.11 |
| 2007/0006696 | A1 * | 1/2007 | Kempski et al. | 83/13 |
| 2008/0098865 | A1 * | 5/2008 | Magula | 83/37 |
| 2009/0169665 | A1 * | 7/2009 | Makida et al. | 425/289 |
| 2010/0287737 | A1 * | 11/2010 | Brussel | D01G 1/10 19/3 |
| 2011/0203433 | A1 * | 8/2011 | Brussel | D01G 1/04 83/74 |
| 2015/0122100 | A1 * | 5/2015 | Schmeiser | 83/674 |

FOREIGN PATENT DOCUMENTS

| | | | |
|---|---|---|---|
| DE | 2442967 | A1 | 3/1976 |
| DE | 102007052586 | A1 | 5/2009 |
| EP | 2057309 | B1 | 10/2012 |
| EP | 2217414 | B1 | 12/2012 |
| WO | 2008/025382 | A1 | 3/2008 |

OTHER PUBLICATIONS

Partial translation of Office Action issued Dec. 10, 2014 for the corresponding EP patent application No. 11 770 689.5.

Office Action dated Feb. 3, 2015 issued in corresponding CA patent application No. 2,812,183.

German Search Report issued from the German Patent Office dated Sep. 27, 2011 for the corresponding German patent application No. 10 2010 045 702.7 (with Partial English translation).

International Search Report of the International Searching Authority mailed May 2, 2012 for the corresponding international application No. PCT/EP2011/004575 (with English translation).

International Written Opinion of the International Searching Authority mailed May 2, 2012 for the corresponding international application No. PCT/EP2011/004575 (with Partial English translation).

International Preliminary Report on Patentability and Written Opinion of the International Searching Authority mailed Mar. 19, 2013 for the corresponding international application No. PCT/EP2011/004575 (in English).

* cited by examiner

FIBER CUTTING DEVICE

CROSS REFERENCE TO RELATED APPLICATIONS

This application is a U.S. national stage application of PCT/EP2011/004575 filed on Sep. 12, 2011, and claims priority to, and incorporates by reference, German patent application No. 10 2010 045 702.7 filed on Sep. 16, 2010.

PRIOR ART

DE 10 2007 052 586 has already disclosed a converter cutting device for a converter which is provided for converting a continuous fiber into cut fibers, with a cutting unit which can be driven in rotation about an axis of rotation and which comprises a cutting means with a cutting edge.

SUMMARY

The invention proceeds from a converter cutting device for a converter which is provided for converting at least one continuous fiber into cut fibers, with at least one cutting unit which can be driven in rotation and which comprises at least one cutting means with at least one cutting edge.

It is proposed that the cutting means forms a cutting angle unequal to 0 degrees with a plane which is oriented perpendicularly to the axis of rotation. Wear of the cutting unit can thereby be reduced. Moreover, a cutting performance of the converter cutting device can consequently be maintained, as compared with known converter cutting devices, with the result that a converter can be provided which has an advantageously long service life and an advantageously high processing speed.

A "cutting unit" is to be understood in this context to mean, in particular, a group of components which are connected fixedly to one another and which, overall, can be driven in rotation. A "cutting means" is to be understood, in particular, to mean a component of the cutting unit which has the at least one cutting edge. A "cutting edge" of the cutting means is to be understood in this context to mean, in particular, a side edge of the cutting means, in which side edge two faces of the cutting means are contiguous to one another at an acute angle. The cutting edge can therefore be described ideally by a line which runs along the side edge forming the cutting edge. The cutting edge has a length of at least 5 millimeters, preferably a length of at least 10 millimeters and especially advantageously a length of approximately 20 millimeters to 30 millimeters, even greater lengths basically being conceivable. The cutting edge is in this case advantageously designed as a straight line. Basically, however, the cutting edge may also be curved. The word "provided" is to be understood, in particular to mean specially equipped and/or designed.

A "cutting angle" which the cutting means forms with the plane is to be understood in this context to mean, in particular, an angle which the cutting means forms, at least in the region of the cutting edge, with the plane perpendicular to the axis of rotation. The cutting angle is preferably designed as an angle which an underside of the cutting means forms with a direction of movement of the cutting means in the plane. A "direction of movement" is to be understood in this context to mean, in particular, a direction vector which defines a provided cutting movement direction of any point on the cutting edge at any point in time. In this case, in particular, it is advantageous if the cutting means has the cutting angle unequal to 0 degrees at at least one point on the cutting edge, but preferably over an entire length of the cutting edge. What can be achieved thereby is that the entire cutting edge forms an angle unequal to 0 degrees with the plane perpendicular to the axis of rotation. To determine the cutting angle, advantageously a point on the cutting edge is used which is at the shortest distance from the axis of rotation of the cutting unit. In principle, the cutting angle may have different angles along an extension of the cutting edge.

Further, it is proposed that the at least one cutting means has a cutting angle of approximately 1 degree. By means of a cutting angle of approximately 1 degree, especially low wear of the cutting edge can be achieved, with the result that an especially long service life can be achieved. The word "approximately" is to be understood in this context to mean, in particular, that the cutting angle lies in a range of between 0.5 degrees and 1.5 degrees and especially advantageously in a range of between 0.8 and 1.2 degrees.

Furthermore, it is proposed that the cutting unit comprises at least one cutting support element which defines the cutting angle unequal to zero for the cutting means. The cutting means can thereby have a simple configuration, and in this case, in particular, conventional cutting means can continue to be used. A "cutting support element" is to be understood in this context to mean, in particular, an element which has for the cutting means a defined bearing surface, the inclination of which defines the cutting angle.

Moreover, it is proposed that the cutting edge comprises an inner point and an outer point, between which it has an axial cutting edge offset. Especially advantageous bearing contact of the cutting element against a countercutting element can thereby be achieved, with the result that the continuous fiber can be cut reliably. An "axial cutting edge offset" is to be understood in this context to mean, in particular, that the inner point of the cutting edge is offset in the axial direction with respect to the outer point of the cutting edge. "Axial direction" is to be understood in this context to mean, in particular, a direction parallel to the axis of rotation of the cutting unit. An "inner point" of the cutting edge is to be understood to mean a point on the cutting edge which is at the shortest distance from the axis of rotation of the cutting unit. An "outer point" of the cutting edge is to be understood to mean a point on the cutting edge which is at the longest distance from the axis of rotation of the cutting unit.

In a development of the invention, it is proposed that the converter cutting device has at least one fixed countercutting unit with at least one countercutting means which forms a countercutting edge. An especially advantageous countercutting edge can thereby be provided. The word "fixed" is to be understood in this context to mean, in particular, that the countercutting unit is fixed at least during normal operation. In principle, at least the countercutting means may be adjustable.

In an advantageous refinement, the cutting edge and the at least one countercutting edge are provided for a shear cut. An especially advantageous cutting action can thereby be achieved. A "shear cut" is to be understood in this context to mean, in particular, that an intersection point of the cutting edge with the countercutting edge travels during a cutting movement, preferably the intersection point traveling from the inner point of the cutting edge successively in the direction of the outer point of the cutting edge. An "intersection point" is to be understood in this context to mean, in particular, a point at which the cutting edge and the countercutting edge intersect in a plane of projection perpendicular to the axis of rotation of the cutting unit.

Preferably, the at least one countercutting means forms a cutting angle of approximately 0 degrees with a plane which is oriented perpendicularly to the axis of rotation. An especially advantageous shear cut can thereby be achieved. A cutting angle of approximately 0 degrees is to be understood in this context to mean, in particular, that the countercutting edge of the countercutting means runs in a plane which is oriented perpendicularly to the axis of rotation of the cutting unit. In this context, "approximately" is to be understood to mean a deviation of at most 0.5 degrees and especially advantageously a deviation of at most 0.2 degrees.

Moreover, it is advantageous if the cutting edge and the countercutting edge are at a maximum cutting distance which is shorter than the cutting offset of the cutting edge. An especially advantageous cut can thereby be achieved. What can thereby be achieved, in particular, is that the cutting edge bears against the countercutting edge over at least one region of the cutting movement, with the result that an especially clean and reliable cut of the continuous fiber can be implemented. A "cutting distance" is to be understood in this context to mean, in particular, a distance between the inner point of the cutting edge and the countercutting edge. The cutting distance is advantageously greater than zero and lower than 0.1 millimeters, a cutting distance lower than 0.01 millimeters being especially advantageous.

In a further refinement, it is proposed that the converter cutting device comprises at least one continuous fiber feed which is assigned to the at least one countercutting edge and which is provided for introducing at least two continuous fibers simultaneously into a cutting space in the region of the countercutting edge. An especially high cutting capacity can thereby be achieved, since, by means of a single shear cut, the at least two continuous fibers can be cut simultaneously. In this context, "in the region of the countercutting edge" is to be understood to mean, in particular, that the continuous fibers are introduced into the cutting space directly in front of the countercutting edge, as a result of which, during a cutting movement, the two continuous fibers are located between the cutting edge and the countercutting edge.

Preferably, the continuous fiber feed has at least two fiber outlet orifices assigned to the one countercutting edge. An especially advantageous configuration can thereby be achieved. In this context, "assigned" is to be understood to mean, in particular, that a continuous fiber led through the fiber outlet orifice is cut by means of the countercutting edge.

Further, a converter which is provided for converting at least one continuous fiber into cut fibers, with a converter cutting device according to the invention, is proposed.

Preferably, in this case, the converter cutting device has at least three countercutting units distributed about an axis of rotation of the cutting unit. A converter can thereby be provided in which, during a single rotational movement of the cutting unit once about its axis of rotation, a plurality of continuous fibers, in particular continuous fibers of different thickness and/or different type, are cut simultaneously, with the result that an especially advantageous configuration of a converter, particularly with a high cutting capacity, can be implemented in a simple way. Preferably, the converter cutting device comprises a central cutting space, in which the rotatably arranged cutting unit and the at least three fixed countercutting units are arranged. Especially preferably, the at least three countercutting units are distributed uniformly about the axis of rotation of the cutting unit.

Furthermore, it is advantageous if the converter has a fiber-draw-forward device for feeding at least one continuous fiber, which device has at least one roller draw-forward unit and at least one compressed-air draw-forward unit. Advantageously simple conveyance of the at least one continuous fiber can thereby be achieved, with the result that the converter can have a reliably high cutting capacity. Preferably, in this case, the compressed-air conveying unit is provided for threading in the continuous fiber, with the result that a continuous fiber can be threaded into the fiber-draw-forward device in a simple way.

Further, it is proposed that the compressed-air draw-forward unit has at least one entry-side guide tube and one exit-side guide tube. An advantageous configuration of the fiber-draw-forward device can thereby be achieved, which makes it possible, in particular, to have reliable normal operation and to thread in the continuous fiber in a simple way.

Moreover, it is advantageous if the fiber-draw-forward roller unit has at least one draw-forward roller which is arranged between the guide tubes of the compressed-air draw-forward unit. The fiber-draw-forward unit can thereby be configured especially advantageously. In particular, reliable transport of the continuous fiber can be achieved as a result, while at the same time a draw-forward speed can advantageously be set.

BRIEF DESCRIPTION OF THE DRAWINGS

Further advantages may be gathered from the following drawing description. The drawings illustrate an exemplary embodiment of the invention. The drawings, description and claims contain numerous features in combination. A person skilled in the art will expediently also consider the features individually and combine them into appropriate further combinations.

DETAILED DESCRIPTION

Figure 1:
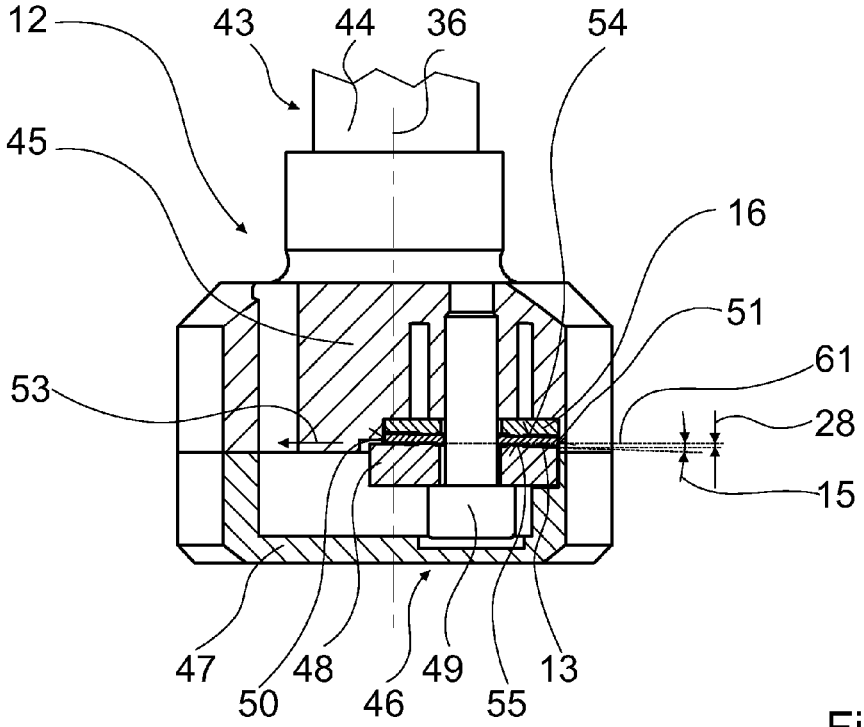
FIG. 1 is a cross sectional view through a cutting unit of a converter cutting device.
Figure 2:
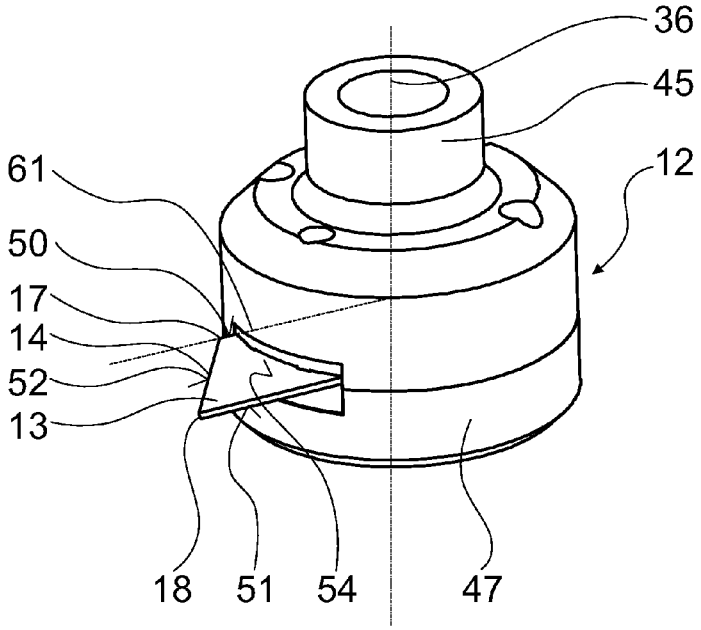
FIG. 2 is a view of the cutting unit in a perspective illustration.
Figure 3:
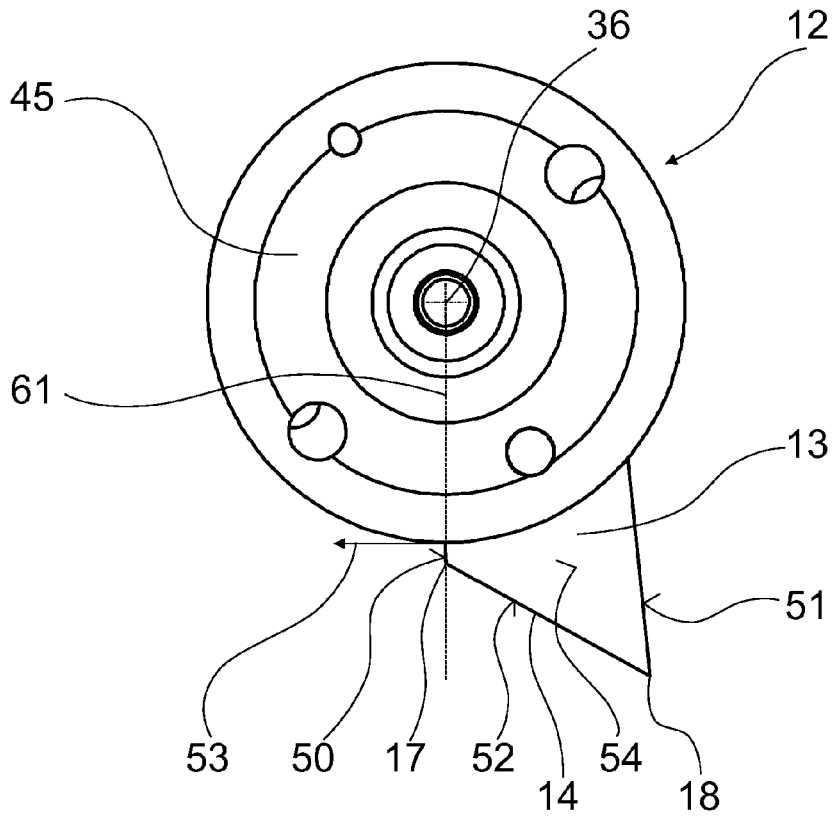
FIG. 3 is a top view of the cutting unit.
Figure 4:
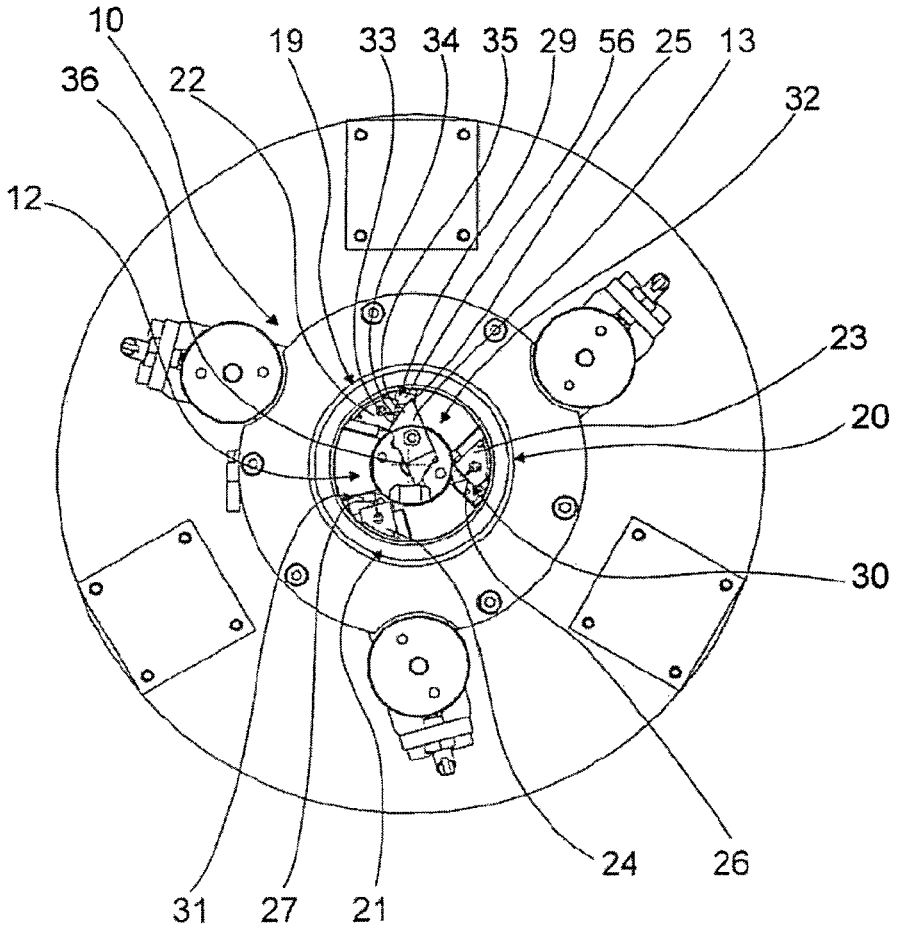
FIG. 4 is an overall view of an underside of the converter cutting device.
Figure 5:
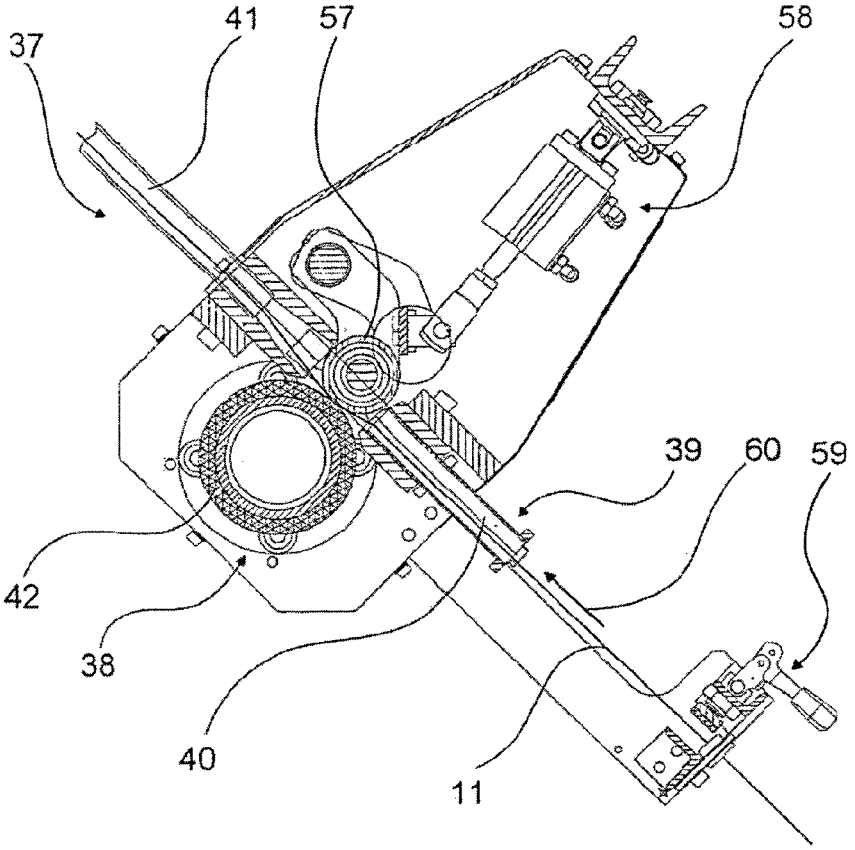
FIG. 5 is a view of a fiber-draw-forward device for feeding a continuous fiber.

FIGS. 1 to 4 show a converter which is provided for converting endless fibers into cut fibers. The converter comprises a converter cutting device 10 and a fiber-draw-forward device 37. The fiber-draw-forward device 37 feeds the continuous fibers to the converter cutting device 10 at an adjustable draw-forward speed. The converter cutting device 10 cuts the continuous fibers into short cut fibers.

The converter cutting device 10 comprises a rotatably arranged cutting unit 12 and a fixed countercutting unit 19. Further, the converter cutting device 10 comprises a drive 43 for the cutting unit 12. The drive 43 comprises a driving machine, not illustrated in any more detail, with a drive shaft 44, to which the cutting unit 12 is connected. The cutting unit 12 forms a cutting head which can be driven in rotation by means of the driving machine.

The cutting unit 12 is of multipart form. The cutting unit 12 comprises a basic body 45 which provides a receptacle for mounting the drive shaft 44 of the driving machine. Further, the cutting unit 12 comprises a cutting means 13 which is connected fixedly to the basic body 45. To tie up the cutting means 13 to the basic body 45, the cutting unit 12 comprises a cutting edge receptacle with a cutting edge support element 16 and with a clamp fastening 46. Moreover, the cutting unit 12 comprises a cover 47 which covers the cutting edge receptacle.

The clamp fastening 46 comprises a clamping disk 48 and a screw 49 for providing a clamping force. The cutting means 13 of the cutting unit 12 is tension-mounted between the clamping disk 48 of the clamp fastening 46 and the cutting support element 16. The screw 49 of the clamp fastening 46 is screwed into the basic body 45. Starting from a head of the screw 49, the screw 49 passes in succession through the clamping disk 48, the cutting means 13 and the cutting edge support element 16 before it engages into a thread in the basic body 45.

The basic body 45 and the cover 47 have an essentially round cross section in a cross-sectional plane running perpendicularly to an axis of rotation 36 of the cutting unit 12. The cutting means 13 of the cutting unit 12 projects laterally beyond the cross section of the basic body 45 with respect to the axis of rotation 36. The cutting means 13 is in this case fastened decentrally to the basic body 45. In particular, the cutting edge receptacle with the clamp fastening 46 is arranged so as to be offset with respect to the axis of rotation 36.

The cutting means 13 and the cutting receptacle form an unbalance. The cover 47 which covers the cutting receptacle forms a counterweight. The cutting unit 12 thus has a symmetrical weight distribution with respect to the axis of rotation 36.

The screw 49 of the clamp fastening 46 is arranged approximately centrally between the axis of rotation 36 and a margin of the basic body 45. The cutting receptacle extends over a region which occupies approximately half of the basic body 45. The cutting means 13 of the cutting unit 12 is thus arranged asymmetrically with respect to the axis of rotation 36.

The cutting means 13 has two blunt side edges 50, 51 and at least one sharp side edge 52. A fourth side edge, not illustrated in any more detail, may likewise be sharp. The two blunt side edges 50, 51 are arranged opposite one another. They run virtually parallel to one another. The two sharp side edges, of which only the side edge 52 is illustrated, are likewise arranged opposite one another. The blunt side edges 50, 51 and the sharp side edge 52 are respectively at an angle of approximately 45 degrees and of 135 degrees to one another. The cutting means 13 thus has a shape which corresponds approximately to a parallelogram.

The two blunt side edges 50, 51, between which the sharp side edge 52 is arranged, project out of the basic body 45. The sharp side edge 52 is therefore arranged outside the basic body 45 and forms a cutting edge 14, by means of which the continuous fiber is cut.

During cutting operation, the cutting unit 12 is driven in rotation. A cutting movement is consequently executed as a rotational movement about the axis of rotation 36 of the cutting unit 12. A direction of movement 53 in which the cutting means 13 is moved is therefore directed in the circumferential direction with respect to the axis of rotation 36. The provided direction of movement 53 which the cutting means 13 executes is therefore defined by a tangent of a circle which has the axis of rotation 36 as its center and which the axis of rotation 36 passes perpendicularly through.

The cutting means 13 forms an angle unequal to 0 degrees with the provided direction of movement 53. The cutting means 13 therefore forms a cutting angle 15 unequal to 0 degrees with a plane which is oriented perpendicularly to the axis of rotation 36. To set the cutting angle 15, the entire cutting means 13 is tilted about a tilting axis 61 which runs in the plane parallel to the axis of rotation 36. Basically, however, it is also conceivable that the cutting means 13 has the cutting angle 15 unequal to 0 degrees in subregions only, for example in the case of a cutting means of curved form. In particular, in this case, it is conceivable that the cutting means 13 has the cutting angle unequal to 0 degrees solely in the region of the cutting edge, for example as a result of corresponding grinding in the region of the cutting edge.

The cutting means 13 is of plate-like form, that is to say has an essentially constant thickness which is markedly lower than a length of the side edges 50, 51, 52. The cutting means 13 therefore has two main faces which run parallel to one another and which form a top side 54 and an underside 55 of the cutting means 13. The underside 55 of the cutting means 13 confronts the countercutting unit 19.

The cutting angle 15 of the cutting means 13 is defined by the underside 55. The cutting angle 15 can therefore be illustrated by an extension of the underside 55 in a cross-sectional plane in which lies a direction vector defining the direction of movement 53. The main axis of rotation 36, of which the projection in the cross-sectional plane can be illustrated, runs perpendicularly to the direction of movement 53 in this cross-sectional plane. The cross-sectional plane for determining the cutting angle 15 is therefore defined by the direction of movement 53 and the projection of the axis of rotation 36.

The tilting axis 61 runs perpendicularly to the axis of rotation 36. The side edge 50 runs parallel to the tilting axis 61. The tilting axis 61 itself therefore has an extension which corresponds virtually to a radial extension with respect to the axis of rotation 36. A minimum distance between the tilting axis 61 and the axis of rotation 36 is virtually zero.

The cutting edge 14 of the cutting means 13 is linear. The cutting edge 14 has a length of approximately 20 millimeters. The cutting means 13 therefore has the same cutting angle 15 over the entire length of the cutting edge 14. The cutting angle 15 which the cutting means 13 has amounts to approximately 1 degree. With respect to the cutting edge 14, the cutting angle 15 is negative, that is to say it has the effect that, during a cutting movement, a distance between the cutting edge 14 and a countercutting edge 25 becomes shorter at an intersection point.

The two blunt side edges 50, 51 of the cutting means 13 form a front side and a rear side of the cutting means 13. During a cutting movement, first, a point on the side edge 50 designed as the front side runs over a fixed point, for example, on the countercutting unit 19 before an equivalent point on the side edge 51 designed as the rear side runs over this point.

In a plane perpendicular to the axis of rotation 36 of the cutting unit, the cutting edge 14 has an extension which is oriented obliquely to the direction of movement. The cutting edge 14 therefore comprises an inner point 17, which is at the shortest distance from the axis of rotation 36, and an outer point 18, which is at the longest distance from the axis of rotation 36.

The cutting angle 15, defined as the angle which the underside 55 of the cutting means 13 forms with the plane perpendicular to the axis of rotation 36, specifically starting from the inner point 17 and parallel to the direction of movement 53, has the effect that the cutting edge 14 likewise forms an angle unequal to 0 degrees with the plane perpendicular to the axis of rotation. Owing to the negative cutting angle 15, the cutting edge 14, starting from the inner point 17, runs obliquely in the direction of the countercutting unit 19. The inner point 17 of the cutting edge 14 is offset axially along the axis of rotation 36 with respect to the outer point 18 of the cutting edge 14. The cutting edge 14 therefore has a cutting offset 28 which corresponds to an axial distance between the two points 17, 18 of the cutting edge 14.

The countercutting unit 19 comprises a countercutting means 22 which has a top side which confronts the cutting unit 12 and which runs perpendicularly to the axis of rotation 36 of the cutting unit 12. The countercutting means 22 therefore forms a cutting angle of 0 degrees with a plane which is oriented perpendicularly to the axis of rotation 36. The top side of the countercutting means 22 in this case runs parallel to the plane which is oriented perpendicularly to the axis of rotation 36 of the cutting unit 12. The countercutting means 13 forms a countercutting edge 25 which runs in the radial direction with respect to the axis of rotation 36 of the cutting unit 12.

A cutting distance between the cutting means 13 of the cutting unit 12 and the countercutting means 22 of the countercutting unit 19 is shorter than the cutting offset 28 of the cutting means 13. The cutting distance is in this case defined as a distance by which the inner point 17 of the cutting edge 14 is spaced apart from the countercutting edge 25. The cutting distance amounts to approximately 0.01 millimeters.

During a cutting movement, the inner point 17 runs at a distance over the countercutting edge 25. As the cutting movement continues, all the points between the inner point 17 of the cutting edge 14 and the outer point 18 of the cutting edge 14 run over the countercutting edge 25 in succession. The cutting movement is consequently designed as a shear cut for which the cutting edge 14 and countercutting edge 25 are provided.

Owing to the negative cutting angle 15, during the cutting movement one of the points which are arranged between the inner point 17 and the outer point 18 of the cutting edge 14 comes into contact with the countercutting edge 25. In a continuation of the cutting movement, the negative cutting angle 15 causes the cutting edge 14 to exert pressure force upon the countercutting edge 25. In the course of the cutting movement, in this case a distance between the cutting edge 14 and the countercutting edge 25 is equal to zero.

The converter cutting device 10 comprises a cutting space 32 in which the cutting unit 12 and countercutting unit 19 are arranged. Further, the converter cutting device 10 comprises a continuous fiber feed 29 which is provided for introducing two or more continuous fibers simultaneously into the cutting space 32. The continuous fiber feed 29 is in this case assigned to only the one countercutting edge 25 of the countercutting unit 19, that is to say the continuous fibers introduced simultaneously into the cutting space are cut by the countercutting edge 25 during a cutting movement of the cutting edge 14.

The continuous fiber feed 29 comprises an outlet element 56 into which three fiber outlet orifices 33, 34, 35 are introduced. The three fiber outlet orifices 33, 34, 35 are arranged along the countercutting edge of the countercutting unit 19. The fiber outlet orifices 33, 34, 35 are in this case arranged in the radial direction one behind the other in a region in front of the countercutting edge 25, with the result that they are cut by means of a single shear cut during a cutting movement.

The outlet element 56 is exchangeable. The outlet element 56 used in the exemplary embodiment illustrated comprises the three fiber outlet orifices 33, 34, 35 which have a different size. In principle, instead of the outlet element 56, an outlet element may also be used which has only two or only one fiber outlet orifice. In this case, in principle, fiber outlet orifices with different diameters may also be used. Both a number of continuous fibers and a diameter of the continuous fibers can be adapted to different requirements by means of the exchangeable outlet element 56.

The converter cutting device 10 comprises, in addition to the countercutting unit 19 described, two further countercutting units 20, 21 which are of similar design. The converter cutting device 10 therefore comprises the three similarly designed fixed countercutting units 19, 20, 21 and the cutting unit 12 which can be driven in rotation.

The three countercutting units 19, 20, 21 are arranged symmetrically about the axis of rotation 36. The countercutting units 19, 20, 21 in each case comprise a countercutting means 22, 23, 24 which form in each case a countercutting edge 25, 26, 27 of the corresponding countercutting unit 19, 20, 21. The countercutting edges 25, 26, 27 are arranged here so as to be in each case offset at 120 degrees with respect to one another. The three countercutting means 22, 23, 24 are arranged in the central cutting space 32 of the converter cutting device 10. A rotational movement of the cutting unit 12 over 360 degrees leads to a shear cut on each of the countercutting units 19, 20, 21.

To draw the continuous fibers forward, the fiber-draw-forward device 37 of the converter comprises a roller draw-forward unit 38 and a compressed-air draw-forward unit 39. The roller draw-forward unit 38 has a driven draw-forward roller 42 and a pressure roll 57. The compressed-air draw-forward unit 39 comprises a compressed-air feed, by means of which an air stream is generated along a conveying direction 60 of the continuous fibers.

The roller draw-forward unit 37 comprises an adjusting mechanism 58, by means of which the pressure roll 57 can be lifted off from the draw-forward roller 42. The compressed-air draw-forward unit 39 comprises two guide tubes 40, 41 which are arranged along the conveying direction 60 fore and aft of the roller draw-forward unit 38. The exit-side guide tube 41, which is followed by the converter cutting device 10, is arranged fixedly. The entry-side fiber guide tube 40 is arranged displaceably.

To thread a continuous fiber 11 into the fiber-draw-forward device 37, the draw-forward roller 42 and the pressure roll 57 are moved apart from one another. The two fiber guide tubes 40, 41 of the compressed-air draw-forward unit 39 are subsequently pushed so near to one another that the continuous fiber, when introduced into the entry-side guide tube 40, is automatically drawn into the exit-side guide tube 41 by the air stream. The guide tubes 40, 41 are in this case led through between the draw-forward roller 42 and the pressure roll 57.

An air stream is subsequently generated in the guide tubes 40, 41. By means of the air stream, the continuous fiber 11, which has been introduced into the entry-side guide tube 40, is automatically drawn through the fiber-draw-forward device 37 and, in particular, between the draw-forward roller 42 and the pressure roll 57.

To fix the continuous fiber 11, the fiber-draw-forward device comprises a fiber clamping unit 59. The fiber clamping unit 59 is arranged in front of the entry-side fiber guide tube 40 with respect to the conveying direction 60. As soon as the continuous fiber 11 passes completely through the fiber-draw-forward device 37, the continuous fiber 11 is secured by means of the fiber clamping unit 59.

The two guide tubes 40, 41 are subsequently pushed apart from one another and the pressure roll 57 is brought into contact with the draw-forward roller 42. The continuous fiber 11 is thereby clamped between the draw-forward roller 42 and the pressure roll 57. The fiber clamping unit 59 can be opened again.

During normal cutting operation, in which the converter cutting device 10 comminutes the continuous fibers into cut fibers, a conveying speed for the continuous fiber 11 is set by means of the roller draw-forward unit 38. The conveying speed is in this case set via a rotational speed of the draw-forward roller 42. The compressed-air draw-forward unit 39 is provided, during normal operation, for transporting the continuous fiber 11 through the guide tubes 40, 41 and further guide tubes, not illustrated in any more detail, which may be arranged fore or aft of the fiber-draw-forward device 37.

The invention claimed is:

1. A converter cutting device for a converter which is provided for converting at least one continuous fiber into cut fibers, comprising:

at least one cutting unit rotatably driven in rotation about an axis of rotation, at least one drive for the cutting unit, comprising at least one shaft to which the cutting unit is connected to form a cutting head which can be driven in rotation about the axis of rotation; and at least one fixed countercutting unit, wherein the cutting unit has at least one cutting means having at least one cutting edge, wherein the cutting means is moved along a direction of movement during a cutting operation, wherein the direction of movement is oriented in a circumferential direction with respect to the axis of rotation, the fixed countercutting unit has at least one countercutting edge, a cutting angle is provided at least at the cutting edge of the cutting means, and the cutting angle is unequal to 0 degrees with a plane which is oriented perpendicularly to the axis of rotation, the cutting means comprises an inner point and an outer point between which the cutting edge extends, wherein the inner point is at a shortest distance from the axis of rotation and the outer point is at a longest distance from the axis of rotation, the entire cutting means is tilted about a tilting axis to set the cutting angle, and the tilting axis runs in the plane which is oriented perpendicularly to the axis of rotation, the tilting axis extends along a radial direction with respect to the axis of rotation, and with respect to the tilting axis, the inner point is offset to the outer point along a direction running perpendicular to the rotation axis, the inner point is offset to the outer point along a direction running parallel to the axis of rotation and the inner point is offset to the outer point along the direction of movement.

2. The converter cutting device as claimed in claim 1, wherein the at least one cutting means has a cutting angle of approximately 1 degree.

3. The converter cutting device as claimed in claim 2, wherein the cutting unit comprises at least one cutting support element which defines the cutting angle unequal to zero for the cutting means.

4. The converter cutting device as claimed in claim 1, wherein the cutting edge and the at least one countercutting edge are provided for a shear cut.

5. The converter cutting device as claimed in claim 1, wherein the at least one countercutting means forms a cutting angle of approximately 0 degrees with a plane which is oriented perpendicularly to the axis of rotation.

6. The converter cutting device as claimed in claim 1, wherein the cutting edge and the at least one countercutting edge have a maximum cutting distance which is shorter than the cutting edge offset of the cutting edge.

7. The converter cutting device at least as claimed in claim 1, further comprising:

at least one continuous fiber feed which is assigned to the at least one countercutting edge and which is provided for introducing at least two continuous fibers simultaneously into a cutting space in the region of the countercutting edge.

8. The converter cutting device as claimed in claim 7, wherein the continuous fiber feed has at least two fiber outlet orifices assigned to the one countercutting edge.

9. A converter with a converter cutting device as claimed in claim 1.

10. The converter as claimed in claim 9, wherein the converter cutting device has, in addition to the fixed counter cutting unit, two further fixed counter cutting units, which are distributedly arranged around the rotation axis of the cutting unit and which comprise respectively one counter cutting means that respectively implements a counter cutting edge of the respective counter cutting unit.

11. The converter as claimed in claim 9, further comprising:

a fiber-draw-forward device for feeding in at least one continuous fiber, which fiber-draw-forward device has at least one draw-forward roller unit and at least one compressed-air draw-forward unit.

12. The converter as claimed in claim 11, wherein the compressed-air draw-forward unit has at least one entry-side guide tube and one exit-side guide tube.

13. The converter as claimed in claim 12, wherein the draw-forward roller unit has at least one draw-forward roller which is arranged between the guide tubes of the compressed-air draw-forward unit.

14. The converter cutting device as claimed in claim 1, wherein the cutting means has two main surfaces which run parallel to one another and which form a top side and an underside of the cutting means with respect to the rotation axis wherein the top side and the underside each have a planar extension.

15. The converter cutting device as claimed in claim 14, wherein the cutting means is of plate-like form.

16. The converter cutting device as claimed in claim 1, wherein the cutting edge is formed by a sharp side edge of the cutting means, in which sharp side edge two surfaces of the cutting means are contiguous to one another at an acute angle, wherein the sharp side edge and the tilting axis include an angle unequal to 90 degrees.

17. The converter cutting device as claimed in claim 1, wherein the cutting unit comprises at least one cutting support element which defines the cutting angle unequal to zero for the cutting means.

* * * * *